United States Patent [19]

Hultquist

[11] Patent Number: 4,502,317

[45] Date of Patent: Mar. 5, 1985

[54] DENT PULLING TOOL

[76] Inventor: John V. Hultquist, 10500 Westminster St. #13, Garden Grove, Calif. 92643

[21] Appl. No.: 538,186

[22] Filed: Oct. 3, 1983

Related U.S. Application Data

[63] Continuation-in-part of Ser. No. 251,952, Apr. 7, 1981, Pat. No. 4,429,562.

[51] Int. Cl.[3] ..... B21D 1/12

[52] U.S. Cl. ..... 72/479; 72/705

[58] Field of Search ..... 72/479, 705, 701, 379, 72/378; 294/97, 86.14, 86.16

[56] References Cited

U.S. PATENT DOCUMENTS

| | | | |
|---|---|---|---|
| 3,132,890 | 5/1964 | Beaudet | 294/97 |
| 3,307,871 | 3/1967 | Russell et al. | 294/97 |
| 3,972,554 | 8/1976 | Tryon | 294/97 |
| 4,235,090 | 11/1980 | Wightman et al. | 72/479 |
| 4,429,562 | 2/1984 | Hultquist | 72/705 |

*Primary Examiner*—Lowell A. Larson

*Attorney, Agent, or Firm*—Dean P. Edmundson

[57] ABSTRACT

An improved tool is described having particular utility as a dent pulling tool for removing dents from automobile bodies and the like. The tool includes a cylinder mounted on a shank. The cylinder may be oriented parallel to the shank to permit it to be inserted through a hole in the metal to be straightened. Then the cylinder is tilted perpendicular to the shank by means of a rod. A sheath is slidably mounted on the shank below the cylinder and it is adapted to prevent the hole from closing around the shank as the metal is pulled outward.

16 Claims, 13 Drawing Figures

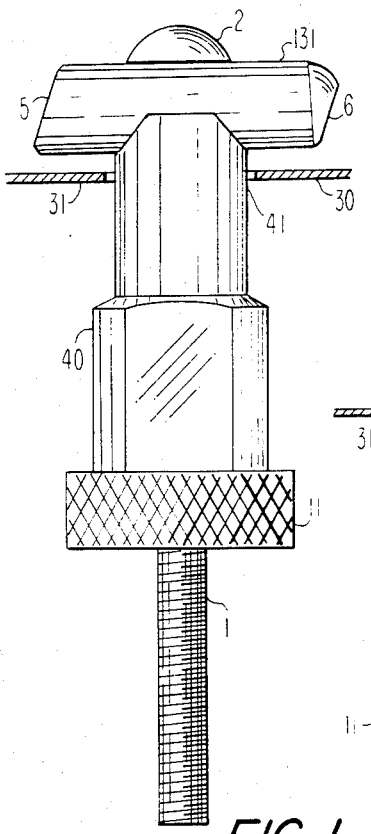
FIG. 1
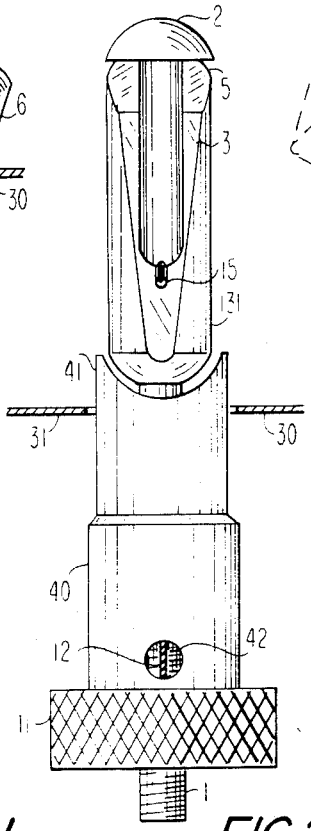
FIG. 2
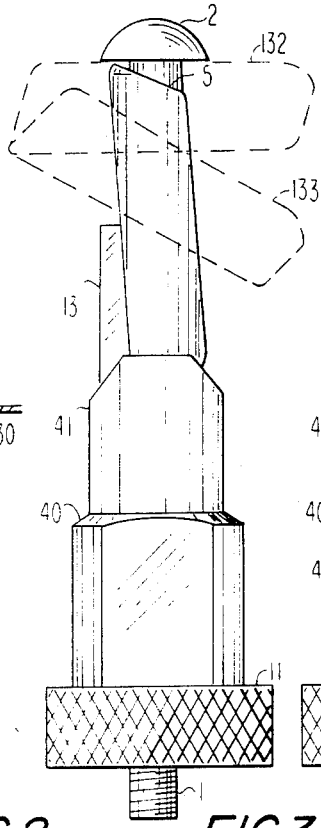
FIG. 3
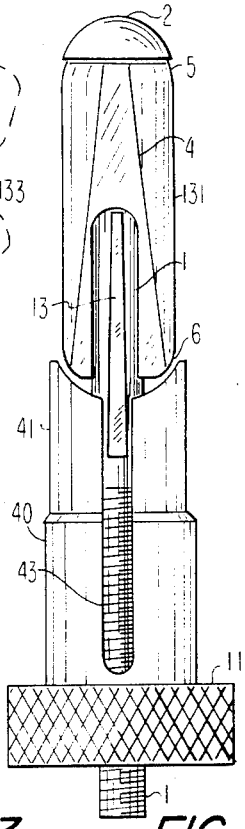
FIG. 4
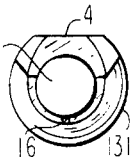
FIG. 5
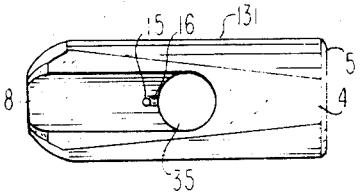
FIG. 6
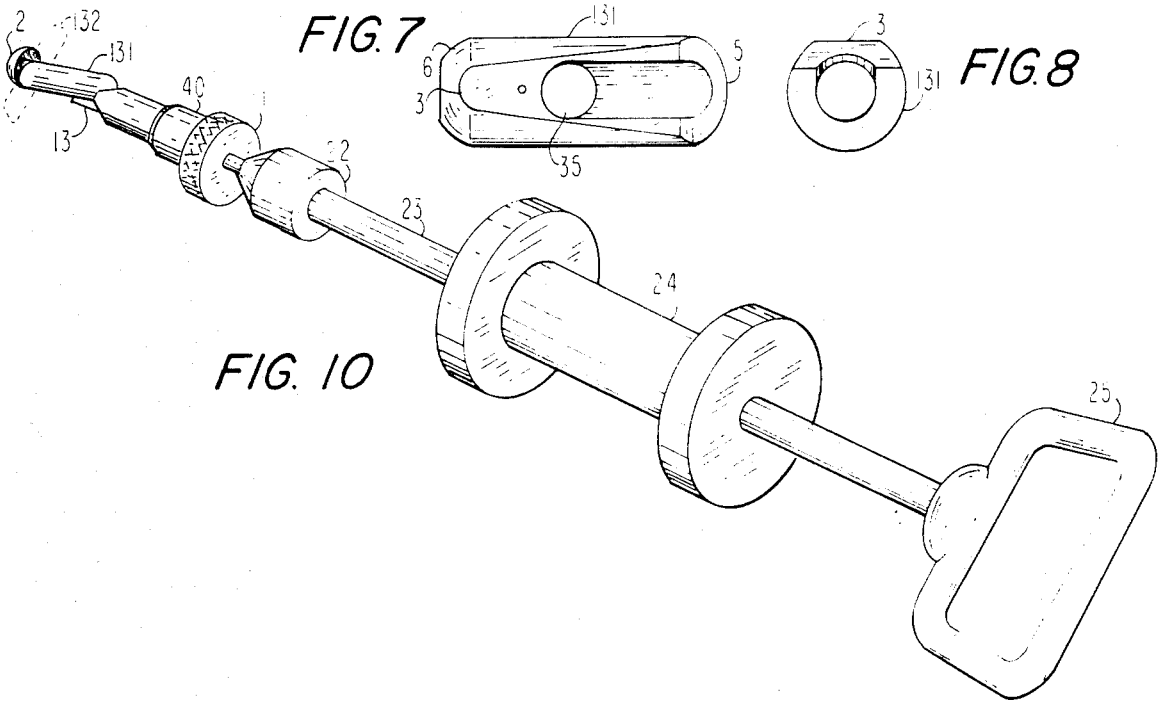
FIG. 7
FIG. 8
FIG. 10

DENT PULLING TOOL

CROSS-REFERENCE TO RELATED APPLICATION

This application is a continuation-in-part of my copending application Ser. No. 251,952, filed Apr. 7, 1981, now U.S. Pat. No. 4,429,562, Feb. 7, 1984.

FIELD OF THE INVENTION

This invention relates to devices and techniques for removing dents from sheet metal and the like. More particularly, this invention relates to devices and techniques for use in automobile body repair.

BACKGROUND OF THE INVENTION

In the art of automobile body repairing, various internal pulling and impacting devices are used to pull out damaged body areas when access is limited due to the boxed-in structure of some parts of the vehicle. Some of the devices used for this type of repair along with a pulling or impacting device are described in U.S. Pat. Nos. 832,920, 2,470,498, 3,332,118, 3,577,881, 3,641,805, 4,122,699, and 4,235,090. Lifting devices are described in U.S. Pat. Nos. 2,584,124; 2,789.859; and 3,307,871.

None of these foregoing devices, however, have provided all of the advantages of the device and technique of the present invention.

SUMMARY OF THE PRESENT INVENTION

In accordance with the present invention there is provided an improved dent pulling tool which includes an elongated shank having a head at one end which is larger than the diameter of the shank. The opposite end of the shank is adapted to be attached to handle means. For example, the end of the shank may be threaded so as to engage a threaded handle.

A cylinder is mounted on the shank, the cylinder having an opening extending through it. The cylinder has slots extending from opposite ends on opposite sides in a manner and at a depth such that a transverse opening is defined which extends through the cylinder transversely. The slots are dimensioned to receive the shank when the cylinder is oriented parallel to the shank. The transverse opening is sufficiently large to enable the cylinder to be tilted perpendicular to the shank.

A lever is slidably mounted on the shank between an outward position and an inward position. A first rod is connected at one end to the lever and at its other end to the cylinder. A second rod is secured to the shank. The first rod is adapted to tilt the cylinder to a perpendicular position on the shank when the lever is moved upward, and the second rod is adapted to tilt the cylinder to a parallel position on the shank when the lever is moved downward.

An elongated sheath is slidably mounted on the shank between the cylinder and the lever. The outside diameter of the sheath at the end nearest the cylinder is at least as large as the diameter of the head of the shank.

The dent pulling tool of this invention is simply and effectively used. The head portion and the cylinder may be inserted into a hole punched through the metal or body part to be straightened. Once the tool is so inserted the cylinder is tilted to a perpendicular position relative to the shank so that the cylinder abuts against the inside of the damaged area so that a pulling or impacting pressure can be applied to the damaged area forcing it back to its original shape. After the necessary pulling or impacting force is completed, the tool may be easily removed by simply tilting the cylinder to a position parallel to the shank. The sheath prevents the metal from closing in the hole when the tool pulls the damaged area outward.

Other advantages of the tool of the present invention will be apparent from the following description.

BRIEF DESCRIPTION OF THE DRAWINGS

The invention is described in more detail hereinafter with reference to the accompanying drawings, wherein like reference characters refer to the same parts throughout the several views and in which:

FIG. 1 is a side view of one embodiment of the dent pulling tool of the invention showing the cylinder in tilted position perpendicular to the shank;

FIG. 2 is a side view of the tool of FIG. 1 rotated 90° and with the cylinder in a position parallel to the shank;

FIG. 3 is a side view of the tool of FIG. 2 rotated another 90°;

FIG. 4 is a side view of the tool of FIG. 3 rotated another 90°;

FIG. 5 is an end view of one type of cylinder which is useful in the tool of this invention;

FIG. 6 shows one of the flat-sided surfaces of the cylinder used in the present invention;

FIG. 7 shows the opposite flat-sided surface of the cylinder shown in FIG. 6;

FIG. 8 is an end view of the opposite end of the cylinder shown in FIG. 5;

FIG. 10 shows one embodiment of the dent removing tool of the invention to which is attached an impacting device or slide hammer;

DETAILED DESCRIPTION OF THE INVENTION

Figure 9:
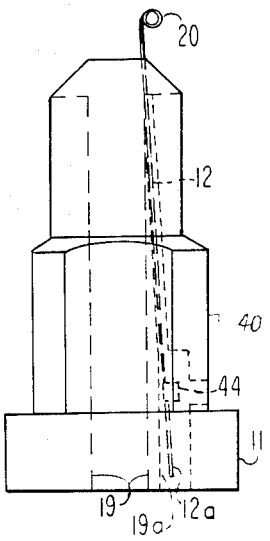
FIG. 9 shows the control rod and the manner in which it passes through the sheath used in the tool of the invention.

The improved tool of the invention allows access for a modified cylinder-shaped object to be inserted through a drilled or punched round hole or existing hole in metal (e.g., an automobile body) where access is prohibited by a boxed-in structure. After the cylinder is inserted through the hole the cylinder is tipped at an angle or perpendicular angle from the shank of the tool. This, therefore, allows the shank to which the slotted cylinder is attached to be pulled or drawn back by a pulling device such as a come-along or a reverse-acting impacting tool (such as a common device known as a slide hammer). This tool would be very useful in repairing damaged areas on automobiles, or in handling of other objects or materials where access is prohibited from the inside of a boxed-in object. The tool is as easily removed as it is inserted.

The tool utilizes a slotted cylinder-shaped object surrounding a shaft that has a head similar to a common bolt. The cylinder is slotted from opposite ends on opposite sides. The depth of the slots is one-half the thickness of the diameter of the cylinder plus the one-half diameter of the shaft it surrounds. Both ends of the cylinder are rounded and the end closest to the head of the shaft is angled for the purpose of aiding in tipping the cylinder. The rounded end permits simple removal of the cylinder back out of the same hole in the material in which it was inserted. The cylinder is also tapered from opposite directions on opposite sides, the wider portion of each taper starting at the end that is slotted and ending at the opposite end. Therefore, this leaves a V-shaped flat surface to be forced against the material that it has been inserted through, thus allowing a backward pressure to be used on the shank and the slotted cylinder that has been tipped into a perpendicular position to the shank.

After inserting the tool through the hole a rod attached to the cylinder wall is pushed towards the head of the shaft turning the cylinder to a perpendicular position. The removal of the tool is simply made by pulling the rod back, whereupon a second rod attached to the other side of the shank stops the cylinder and tips it into a position parallel to the shank so that the tool may be removed from the hole. The top of the second rod is disposed below the head of the shank a distance approximately equal to the length of one of the slots less the diameter of the shank (i.e., a distance approximately equal to half the length of the cylinder).

In FIG. 1 there is shown one embodiment of dent pulling tool of the invention including elongated shank 1 having a rounded head 2 which is larger than the shank, as shown. The lower end of shank 1 is preferably threaded to facilitate connection of handle means.

Cylinder 131 is shown in tilted position perpendicular to shank 1 and abuts against the back side of the material denoted as 30 and 31 (such as sheet metal in an auto body) when the tool is in use.

Sheath 40 has an opening extending therethrough from one end to the other and is slidably mounted on shank 1 between cylinder 131 and lever 11. The upper end 41 of sheath 40 is saddle-shaped, as shown in FIGS. 2 and 4, in such a manner that it engages the side of cylinder 131 when the cylinder is tilted perpendicular to the shank, and it receives the end of cylinder 131 when the cylinder is oriented parallel to the shank. The outside diameter of portion 41 of sheath 40 is at least as large or larger than the diameter of head 2.

FIG. 2 shows the flat surface 3 on one side of cylinder 131, the angled rounded end 5 of the cylinder, and the opposite rounded end 6 of the cylinder. FIGS. 1 and 2 also illustrate the manner in which the upper end 41 of sheath 40 projects through the hole in the material to be straightened in order to prevent the material from closing the hole as the dent is pulled out.

FIG. 2 also shows the upper end of rod 12 connected to cylinder 131 by means of loop 20 passing through a small hole 15 in cylinder 131. The lower end of rod 12 is visible through aperture 42 at the lower end of sheath 40.

Cylinder 131 is tilted from its position parallel to shank 1 to a position perpendicular to shank 1 by means of rod 12 which is attached to cylinder 131 at its upper end and to lever 11 at its lower end. By sliding lever 11 upwardly on shank 1, cylinder 131 is caused to tilt. In order to tilt cylinder 131 to a position parallel to shank 1, lever 11 is slidably urged downward along shank 1 whereby rod 13 (which is secured to one side of shank 1) stops downward movement of the cylinder and causes it to tilt toward shank 1 into a parallel position, as shown and illustrated in FIG. 3. The position of the cylinder perpendicular to the shank is shown by dotted lines 132. As lever 11 is moved downwardly the position of the cylinder in an intermediate position is shown by dotted lines 133.

Sheath 40 may have a variety of shapes, although the end thereof nearest cylinder 131 is preferably circular in cross-section and at least as large or larger than the head 2 of shank 1. Sheath 40 may, for example, be an elongated cylindrical member of uniform or non-uniform size. If desired, sheath 40 may comprise two cylindrical members in axial alignment, with one of the cylinders having a larger diameter than the other. Sheath 40 may be integral with lever 11 or it may be separate from lever 11. Both the sheath and the lever are freely slidable on the shank.

As shown in FIG. 4, one side of sheath 40 includes an open longitudinal groove or slot 43 which slidably engages rod 13 which is secured to shank 1. Rod 13 is preferably secured to shank 1 on the side opposite the position of rod 12. Rod 13 may be secured, for example, by welding or soldering to shank 1. As illustrated in FIG. 4, the upper end of rod 13 is disposed below head 2 a distance approximately equal to half the length of cylinder 131. It is also preferable for rod 13 to project outwardly from shank 1 a distance no further than the outside dimension of head 2.

Figure 12:
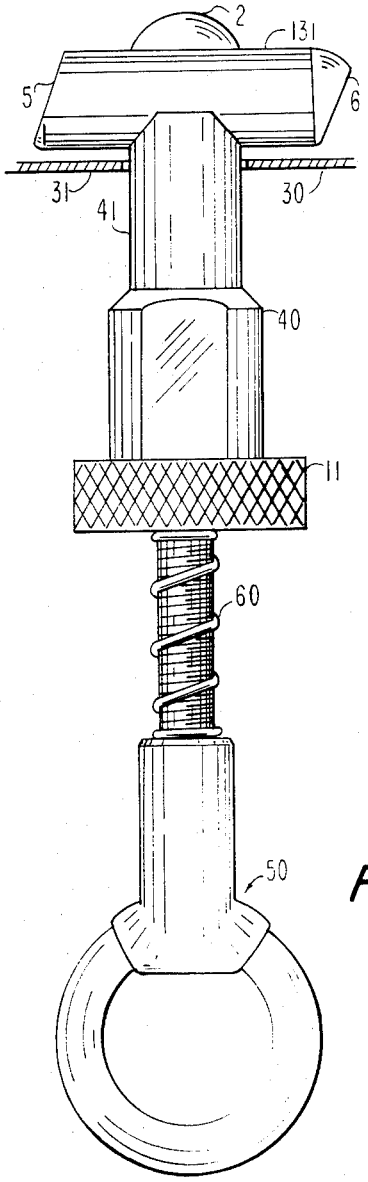
FIG. 12 is a side view of another embodiment of the dent pulling tool of the invention.

An additional advantage of sheath 40 is that it enables cylinder 131 to be locked tightly into position against the underside of head 2. This is accomplished, for example, by threading any suitable handle means onto shank 1 to a point where the handle means abuts against the underside of lever 11 when cylinder 131 is perpendicular to shank 1. This may also be accomplished by including spring 60 on shank 1 between handle means 50 and lever 11, as shown in FIG. 12. This removes any play in the tool during use and makes it more solid during use.

The tool of this invention may, of course, be made in various sizes and lengths so that it may be used in many different applications as a puller and an anchor. By using tool steel to make the tool, and because there is no separate pin connection required between the cylinder and the shank, this tool can withstand great pressure (i.e., pulling forces). The V-shaped flat surface 4 on the working side of cylinder 131 reduces the tendency of the metal to tear when it is pulled or when impacting devices are used with it.

After the dent has been pulled out using the tool of this invention, cylinder 131 is tilted to a position parallel to shank 1 by means of rod 12 and lever 11, cooperating with rod 13, as described above, so that the head of the tool may be removed from the hole in the metal. The upper end 41 of sheath 40 prevents he metal from closing in around shank 1 during the pulling operation. Thereafter the hole is simply filled in a conventional manner by means of body fillers (e.g., plastic) or welding, as necessary.

FIG. 5 is an end view of cylinder 131 showing the opening 8 therethrough. Slot 16 extending along one interior wall of cylinder 131 is optional. If desired it may be included to accommodate rod 12. FIG. 8 shows the cylinder 131 from the opposite end.

FIG. 6 shows flat V-shaped surface 4 of cylinder 131 which bears against the metal to be pulled when the tool is in operation. FIG. 7 shows the other flat V-shaped surface 3 of cylinder 131 which bears against the underside of head 2 during operation of the tool. FIGS. 6 and 7 also show transverse opening 35 which extends transversely through cylinder 131.

FIG. 9 shows rod 12, lever 11, and sheath member 40. Dotted lines 19 indicate an opening extending through lever 11 and sheath 40 which enables sliding vertical movement on shank. Loop 20 on the upper end of rod 12 is for the purpose of attaching rod 12 to cylinder 131 through small hole 15 (shown in FIGS. 2 and 6). The lower end 12*a* of rod 12 is captured within aperture 19*a* of lever 11 by means of a clip or clamp 44 secured to lower end 12*a*.

FIG. 10 shows the tool of the invention set up as automobile body dent removing anchor and puller. Cylinder 131 is shown in a position parallel to the shank for insertion into a hole in the auto body, and dotted lines 132 show the perpendicular position the cylinder will be in during use. Collar 22 is threadably secured to the shank and serves as a connector to shank 23 of an impacting device which uses a hammering action providing by manual operation of a heavy cylindrical body 24 which is adapted to slide freely on shaft 23. Body 24 may be, for example, drawn outwardly with great force which is impacted on handle 25. The operation of this tool causes the metal of the auto body to be pulled outwardly in the direction of the handle.

Figure 11:
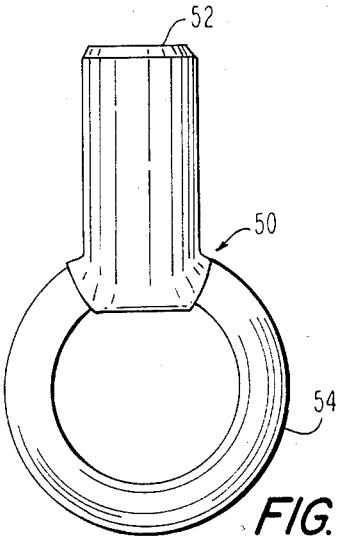
FIG. 11 shows another type of handle means which is adapted to be attached to the dent pulling tool of the invention.

FIG. 11 illustrates another type of handle means 50 having a shank 52 and a ring 54 which are integrally connected. Shank 52 preferably contains internal threads so that it may be threaded onto shank 1 of the tool of the invention. Any suitable pulling device may then be attached to ring 54, as desired.

Figure 13:
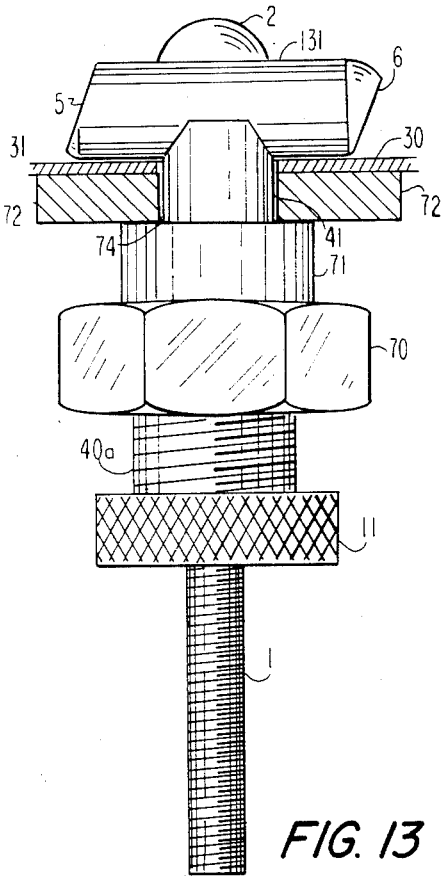
FIG. 13 is a side view of yet another embodiment of the dent pulling tool of the invention.

Another embodiment of the tool of this invention is shown in FIG. 13. In this embodiment the exterior of the sheath 40*a* is threaded along at least a portion thereof so that a threaded nut 70 may be threadably retained thereon. If desired, the entire length of the sheath may be threaded. In the embodiment shown in FIG. 13 the lower portion of the sheath is of a greater diameter than the upper portion thereof, and it is only the lower portion which is threaded. Nut 70, as shown, has a lower threaded portion and an upper collar portion which need not be threaded. The collar portion has a diameter slightly larger than the diameter of the upper portion of the sheath.

A plate 72 (e.g., a metal disk or bar or flat plate) having an opening 74 therein may be slipped over the end of the tool when cylinder 131 is oriented parallel to the shank. Then after the head of the tool is passed through an opening in a metal part (e.g., an automobile body to be repaired), the nut 70 may be turned on sheath 40*a* so that the top collar portion 71 of nut 70 urges plate 72 tightly against the metal part (e.g., auto body). In this manner the tool of this embodiment operates as an extremely secure anchor to the metal part. The presence of the plate which is tightened firmly against the exterior of the metal part is very beneficial in auto body repair operations. The tool of this embodiment is especially useful in pulling dents out of auto bodies where other conventional tools cannot operate effectively.

Other variants are possible without departing from the scope of this invention.

What is claimed is:

1. A dent pulling tool comprising:

(a) an elongated shank having a head at one end which is larger than the diameter of the shank, wherein the other end of said shank is adapted to be attached to handle means;

(b) a cylinder mounted on said shank, said cylinder having an opening extending therethrough from one end of said cylinder to the other end, said cylinder having slots extending from opposite ends on opposite sides thereof in a manner and at a depth such that a transverse opening is defined which extends transversely through said cylinder; wherein said shank extends through said cylinder and said slots are dimensioned to receive said shank when said cylinder is oriented parallel to said shank; and wherein said transverse opening is sufficiently large to enable said cylinder to be tilted perpendicular to said shank;

(c) a lever slidably mounted on said shank between an outward position and an inward position;

(d) a first rod connected at one end to said lever and at its other end to said cylinder;

(e) a second rod secured to said shank, wherein said cylinder is pivoted from a first position parallel to said shank to a second position perpendicular to said shank by means of said first rod when said lever is moved from its outward position to its inward position, and wherein said cylinder is pivoted from its said perpendicular position to its said parallel position by means of one end of said cylinder being urged against said second rod when said lever is moved to its outward position; and (f) an elongated sheath having an opening therethrough from one end to the other, said sheath being slidably mounted on said shank between said cylinder and said lever, wherein the outside diameter of said sheath at the end nearest said cylinder is at least as large as the diameter of said head of said shank.

2. A dent pulling tool in accordance with claim 1, wherein said end of said shank opposite from said head is threaded.

3. A dent pulling tool in accordance with claim 2, further comprising handle means threadably engaging said shank.

4. A dent pulling tool in accordance with claim 1, wherein said sheath and said lever comprise an integral unit.

5. A dent pulling tool in accordance with claim 1, wherein the end of said sheath nearest said cylinder is saddle-shaped in a manner such that it engages said cylinder when said cylinder is tilted to a position perpendicular to said shank.

6. A dent pulling tool in accordance with claim 1, wherein said sheath includes a longitudinal slot which slidably receives said second rod.

7. A dent pulling tool in accordance with claim 1, wherein said first rod comprises a wire.

8. A dent pulling tool in accordance with claim 3, wherein when said cylinder is tilted perpendicular to said shank and said sheath is urged against said cylinder, said handle means is adapted to lock said lever against said sheath.

9. A dent pulling tool in accordance with claim 1, wherein said first rod is connected to said lever by being passed through an aperture in said lever and a clamp affixed thereto.

10. A dent pulling tool in accordance with claim 1, wherein said slots on said opposite sides of said cylinder define surfaces which are parallel to each other.

11. A dent pulling tool in accordance with claim 1, wherein said second rod is secured to the opposite side of said shank from said first rod.

12. A dent pulling tool in accordance with claim 1, wherein said sheath is cylindrical.

13. A dent pulling tool in accordance with claim 1, wherein said sheath comprises two cylindrical portions in axial alignment, one of said portions having a larger diameter than the other.

14. A dent pulling tool in accordance with claim 3, further comprising a spring disposed on said shank between said handle means and said lever.

15. A dent pulling tool in accordance with claim 1, wherein the exterior of said sheath is threaded along at least a portion thereof.

16. A dent pulling tool in accordance with claim 1 further comprising (g) a plate member slidably received on the upper portion of said sheath, and (h) a nut threadably engaging the exterior of said sheath, wherein said nut is adapted to urge said plate member along said sheath toward said cylinder.

* * * * *